United States Patent [19]

Jones

[11] 4,055,273

[45] Oct. 25, 1977

[54] SPILL-RESISTANT CONTAINER

[75] Inventor: Dennis J. Jones, Loogootee, Ind.

[73] Assignee: Tumble Not Tumbler, Inc., Loogootee, Ind.

[21] Appl. No.: 693,102

[22] Filed: June 4, 1976

[51] Int. Cl.[2] ..... B65D 7/42

[52] U.S. Cl. ..... 220/70; 220/90.4; 215/100 R

[58] Field of Search ..... 220/1, 90.2, 90.4, 90.6, 220/69, 70; 215/100; D7/6, 23; 222/559

[56] References Cited

U.S. PATENT DOCUMENTS

| | | | |
|---|---|---|---|
| 1,220,495 | 3/1917 | Cadby | D7/23 |
| 2,509,275 | 5/1950 | Poncy | D7/6 |
| 2,529,114 | 11/1950 | Tellier | 220/90.4 |
| 2,856,095 | 10/1958 | Schnabel | 220/90.4 |
| 3,804,281 | 4/1974 | Eckdahl | D7/6 |
| D. 133,703 | 9/1942 | Parker | D7/23 |
| D. 189,302 | 11/1960 | Skupien | D7/6 |
| D. 233,972 | 12/1974 | Juhlin | 220/90.4 |
| T649,904 | 8/1957 | Chemex Corp. | D7/6 |

FOREIGN PATENT DOCUMENTS

| | | | |
|---|---|---|---|
| 64,013 | 11/1913 | Austria | 220/90.4 |

*Primary Examiner*—Ro E. Hart
*Attorney, Agent, or Firm*—Jenkins, Hanley & Coffey

[57] ABSTRACT

A spill-resistant container having a truncated conical base for receiving liquid, and a generally cylindrical neck extending upwardly from said base. A tip ring is integrally carried on the container between the base and the neck, and provides an overall container diameter approximately equal to the container height. Thus, when tipped, the container rests on the ring in a partially upright position to prevent liquid from spilling therefrom.

11 Claims, 3 Drawing Figures

SPILL-RESISTANT CONTAINER

BACKGROUND OF THE INVENTION

This invention relates to spill-resistant containers. More specifically, this invention relates to an improved spill-resistant drinking container of relatively wide-mounted construction.

A wide variety of spill-resistant drinking glasses and cups for use by infants are available throughout the prior art. Typically, these containers comprise a cup-like receptacle for holding a liquid, together with a snap-on or screw-on lid having small drinking and venting holes formed therethrough. See, for example, U.S. Pat. No. 3,341,062. The lid is removable to allow the container to be filled or cleaned. However, these container constructions are complicated multi-piece devices, with smaller container pieces being easily lost. Further, continual removal and replacement of the lid is both difficult and inconvenient. Because the lid snaps or screws onto the receptacle, the lid tends to have small crevices which easily trap food particles, dried liquid drops, or citrus pulp to thereby make cleaning difficult. The small drinking and venting holes in the lid easily become clogged, and they undesirably greatly restrict the rate at which one can drink from the container. This is particularly undesirable when the cup is used for infants, since infants tend to suck liquid through the drinking holes and thereby do not learn proper drinking habits as from a conventional glass. And, the drinking and venting holes do not prevent spillage when the container is tipped. That is, once tipped, the liquid in the container drains down to the lowest drinking or vent opening.

The spill-resistant container of this invention overcomes the problems and disadvantages of the prior art by providing a spill-resistant container of one-piece construction having a relatively wide-mouthed drinking opening. Moreover, this invention provides such a spill-resistant container which is easy to fill and to clean.

SUMMARY OF THE INVENTION

In accordance with the invention, a spill-resistant container comprises an upright conically-shaped base with an enclosing bottom wall. The conical base is integrally formed with a cylindrical neck extending upwardly therefrom and having an overall height approximately the same as the height of the base. The neck terminates at its upper end in a relatively wide-mouthed drinking opening having a diameter substantially less than the base diameter at the container bottom.

An annular tip ring extends radially outwardly from the container generally between the base and the neck. The ring has an outside diameter generally equal to the height of the container. In use, when the base is filled with liquid and the container is tipped, the tip ring supports the container in partially upright position to prevent spillage of liquid therefrom.

BRIEF DESCRIPTION OF THE DRAWINGS

The accompanying drawings illustrate the invention. In such drawings.

DETAILED DESCRIPTION OF THE PREFERRED EMBODIMENT

Figure 1:
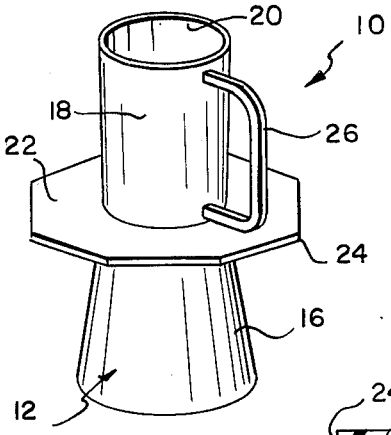
FIG. 1 is a perspective view showing a spillresistant container of this invention.
Figure 2:
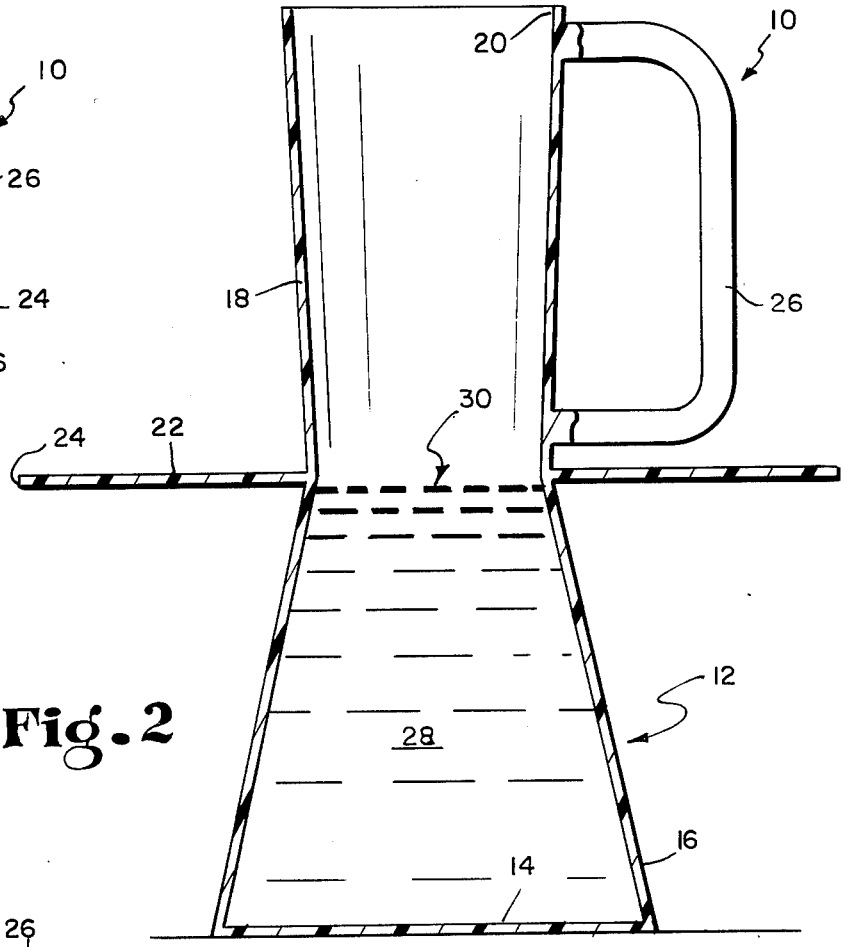
FIG. 2 is a vertical section of the container in the upright position.

A spill-resistant container 10 of this invention is shown in FIGS. 1 and 2, and comprises an upright truncated cone base 12 having an enclosing bottom wall 14 and an upstanding side wall 16 of circular cross section. The base side wall 16 tapers inwardly and upwardly so that the base diameter at the container bottom is approximately twice the diameter at the top of the conical base. For example, the side wall can taper inwardly and upwardly from a diameter of about three inches to about one and one-half inches. The base 12, along with the remainder of the container to be hereafter described, is formed from a high impact resilient plastic such as polyethylene, and has smooth surfaces for easy cleaning.

The top of the base 12 integrally blends into an upwardly extending neck 18. This neck, as shown in FIG. 2, is of cylindrical configuration, and has a height approximately the same as the height of the lower base 12. The neck 18 terminates at its upper end in a relatively wide-mounted drinking opening 20. Importantly, the neck diameter at the drinking opening 20 is on the order of one-half of the diameter of the base 12 at the container bottom. In other words, the neck diameter at the opening 20 is approximately one and one-half inches. Or, if desired, the neck 18 can be slightly flared upwardly and outwardly as shown in FIG. 2 to slightly increase the proportional diameter of the drinking opening 20.

An annular tip ring 22 is integrally carried on the container between the base 12 and the neck 18. Thus, the ring 22 is elevationally carried at approximately one-half of the container height. The ring extends radially outwardly from the base and neck and terminates with an outside diameter roughly equal to the overall container height. Therefore, in the embodiment shown and described, the outside ring diameter is approximately six inches. The tip ring 22 has a discontinuous outer periphery 24, such as the octagonal periphery shown in FIG. 1. Also, the ring can be slightly dished upwardly (not shown) to catch any small drips from the container neck 18.

A handle 26 is conveniently provided for the container, and is integrally connected to the exterior surface of the cylindrical neck 18. The handle thereby permits easy handling of the container for drinking purposes. If desired, a second handle (not shown) can also be mounted on the neck in opposed relation with the handle shown.

Figure 3:
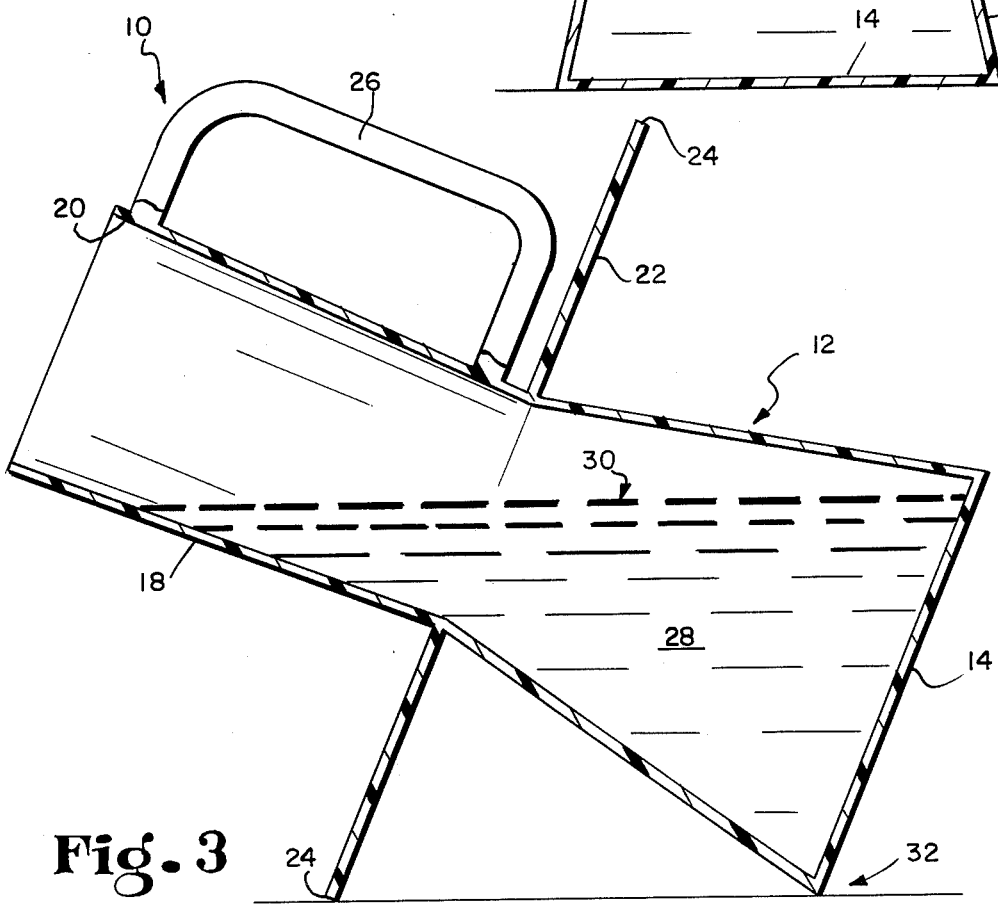
FIG. 3 is a vertical section of the container in a tipped position.

In the container of this invention, the conical base 12 provides an enlarged lower reservoir for a liquid 28, such as juice, milk, etc., with a fill level occurring when the liquid surface level 30 is at or near the top of the base. In this manner, the liquid-storing base 12 causes the filled container to be substantially bottom heavy to thereby reduce the chances of the container tipping. Yet, drinking from the container is fast and easy as with a conventional glass or cup because of the relatively wide-mouthed drinking opening 20. When the container is accidently tipped as shown in FIG. 3, the container rests on its bottom edge 32 and the periphery 24 of the tip ring 22. Thus, the tip ring serves to support the container in a partially upright position to prevent spillage of the liquid. That is, as shown in FIG. 3, the liquid surface 30 is horizontally disposed across both the base and part of the neck 18, but the liquid does not flow from the container. Conveniently, the octagonal periphery 24 of the tip ring 22 prevents rolling of the tipped container to thereby prevent liquid from splashing out of the container.

The spill-resistant container of this invention is advantageous for use with infants, elderly persons, persons with nervous disorders, or any person having manual difficulty in controlling and preventing tipping of a liquid-carrying drinking vessel. The container is desirably quickly and easily molded to have a one-piece construction of the desired size and with the proportions specified herein, with no sharp recesses or crevices to trap food particles. Alternately, if desired, the container can be constructed from several separate pieces interconnected to comprise a one-piece construction.

I claim:

1. A spill-resistant container comprising a truncated conical base with a bottom wall and upstanding side walls, said base being for receiving and holding a quantity of a liquid; a neck extending upwardly from the upper extents of the base side walls, said neck terminating at its upper end to form a relatively wide-mouthed opening having a cross sectional dimension substantially less than the cross sectional dimension of said base at the bottom wall thereof; and a ring carried on the container generally at the top of said base and generally intermediate the height of the container, said ring extending radially outwardly from the container and having an outside diametric dimension generally equalling the container height to support the container when tipped in a partially upright position to prevent spillage of liquid therefrom.

2. A spill-resistant container as set forth in claim 1 wherein said base has a cross sectional dimension at said bottom wall equalling approximately twice the cross sectional dimension at the top of said base.

3. A spill-resistant container as set forth in claim 1 wherein said neck is generally cylindrically shaped.

4. A spill-resistant container as set forth in claim 1 wherein said neck has a height approximately equal to the height of said base.

5. A spill-resistant container as set forth in claim 1 wherein said ring has a discontinuous outer periphery.

6. A spill-resistant container as set forth in claim 1 wherein said neck has a handle carried thereon.

7. A spill-resistant container as set forth in claim 1 wherein said ring has a multiple-sided outer periphery.

8. A spill-resistant container comprising a base with a bottom wall and upwardly and inwardly extending side walls, said base being for receiving a quantity of a liquid and having a cross sectional dimension at the bottom thereof equalling approximately twice the cross sectional dimension at the top of said base; a neck having a height approximately equal to the height of said base and extending upwardly from the top of said base, said neck terminating at its upper end to form a relatively wide-mouthed opening having a cross sectional dimension approximately equal to the cross sectional dimension of the top of said base; and a ring carried on the container generally between said base and neck, said ring extending radially outwardly from the container and having an outside diametric dimension approximately equal to the container height to support the container when tipped in a partially upright position to prevent spillage of liquid therefrom.

9. A spill-resistant container as set forth in claim 8 wherein said base, neck, and ring are of integral construction.

10. A spill-resistant container as set forth in claim 8 wherein said container is formed from a high impact plastic.

11. A spill-resistant container as set forth in claim 8 wherein said ring has a discontinuous outer periphery.

* * * * *

UNITED STATES PATENT OFFICE

CERTIFICATE OF CORRECTION

Patent No. 4,055,273 Dated October 25, 1977

Inventor(s) Dennis J. Jones

It is certified that error appears in the above-identified patent and that said Letters Patent are hereby corrected as shown below:

Column 1, line 8, change "mounted" to --mouthed--;

line 57, before "partially", insert --a--.

Column 2, line 23, change "wide-mounted" to --wide-mouthed--.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*